US008961333B2

(12) United States Patent
Ballenger et al.

(10) Patent No.: US 8,961,333 B2
(45) Date of Patent: Feb. 24, 2015

(54) GOLF CLUB WITH HIGH FRICTION STRIKING SURFACE

(75) Inventors: Matthew Brandon Ballenger, Lexington, KY (US); Roger Steven Cannon, Nicholasville, KY (US); George Bevin Kendrick, Lexington, KY (US); Ernest Christopher Weyhrauch, Richmond, KY (US)

(73) Assignee: Diamondback Group, Lexington, KY (US)

( * ) Notice: Subject to any disclaimer, the term of this patent is extended or adjusted under 35 U.S.C. 154(b) by 378 days.

(21) Appl. No.: 13/102,366

(22) Filed: May 6, 2011

(65) Prior Publication Data

US 2011/0218050 A1 Sep. 8, 2011

Related U.S. Application Data

(63) Continuation-in-part of application No. PCT/US2010/025751, filed on Mar. 1, 2010.

(60) Provisional application No. 61/237,379, filed on Aug. 27, 2009, provisional application No. 61/156,041, filed on Feb. 27, 2009.

(51) Int. Cl.
*A63B 53/04* (2006.01)
*A63B 59/00* (2006.01)

(52) U.S. Cl.
CPC ..... *A63B 53/0487* (2013.01); *A63B 53/04* (2013.01); *A63B 2053/0416* (2013.01); *A63B 2059/0007* (2013.01); *A63B 2209/00* (2013.01);
(Continued)

(58) Field of Classification Search
USPC ..... 473/324–350
See application file for complete search history.

(56) References Cited

U.S. PATENT DOCUMENTS 3,937,474 A * 2/1976 Jepson et al. ..... 473/342
3,989,861 A * 11/1976 Rasmussen ..... 427/180

(Continued)

FOREIGN PATENT DOCUMENTS

GB 2410195 A * 7/2005 ..... A63B 53/04
GB 2447717 A * 9/2008 ..... A63B 53/04

(Continued)

OTHER PUBLICATIONS

International Search Report dated May 3, 2010 for Application No. PCT/US2010/025751.

(Continued)

*Primary Examiner* — Alvin Hunter
(74) *Attorney, Agent, or Firm* — Frost Brown Todd LLC

(57) ABSTRACT

Disclosed herein are golf clubs for reducing the spin imparted to a golf ball, the golf club having a gripping portion around which a golfer can position his hands to swing the golf club, a shaft having a first end and a second end, wherein the gripping portion extends from the first end of the shaft; and a club head extending from the second end of the shaft, the club head having a surface for striking the golf ball, and wherein the surface comprises a high-frictional material to reduce the rotation of a golf ball upon impact with the surface. The striking surface of the golf club may be treated in a variety of manners, including but not limited to placement of an insert into a cavity of a golf club head, material selection, surface material variation, and physical patterning of the surface on a micro-and/or nano-scale.

16 Claims, 7 Drawing Sheets

(52) U.S. Cl.
CPC ..... *A63B2209/10* (2013.01); *A63B 2053/0425* (2013.01); *A63B 2053/042* (2013.01)
USPC ..... 473/330; 473/340; 473/342

(56) References Cited

U.S. PATENT DOCUMENTS

| | | | | | |
|---|---|---|---|---|---|
| 4,326,716 | A * | 4/1982 | LaCoste | 473/349 |
| 4,422,638 | A * | 12/1983 | Tucker | 473/329 |
| 4,754,971 | A * | 7/1988 | Kobayashi | 473/290 |
| 4,768,787 | A * | 9/1988 | Shira | 473/331 |
| 4,917,384 | A * | 4/1990 | Caiati | 473/330 |
| 4,951,953 | A * | 8/1990 | Kim | 473/320 |
| 4,964,641 | A | 10/1990 | Miesch et al. | |
| 5,158,289 | A * | 10/1992 | Okumoto et al. | 473/319 |
| 5,358,249 | A * | 10/1994 | Mendralla | 473/331 |
| 5,437,088 | A * | 8/1995 | Igarashi | 29/527.6 |
| 5,458,332 | A | 10/1995 | Fisher | |
| 5,470,063 | A | 11/1995 | Fisher | |
| 5,531,444 | A * | 7/1996 | Buettner | 473/349 |
| 5,580,051 | A | 12/1996 | Fisher | |
| 5,643,110 | A * | 7/1997 | Igarashi | 473/330 |
| 5,674,132 | A | 10/1997 | Fisher | |
| 5,688,190 | A * | 11/1997 | Rowland et al. | 473/330 |
| 5,716,290 | A * | 2/1998 | Baker et al. | 473/313 |
| 5,804,272 | A | 9/1998 | Schrader | |
| 5,851,158 | A * | 12/1998 | Winrow et al. | 473/330 |
| 5,885,171 | A * | 3/1999 | Sharpe | 473/330 |
| 5,921,871 | A | 7/1999 | Fisher | |
| 5,931,743 | A * | 8/1999 | Baker et al. | 473/313 |
| 5,942,015 | A * | 8/1999 | Culler et al. | 51/295 |
| 6,001,030 | A * | 12/1999 | Delaney | 473/329 |
| 6,095,931 | A * | 8/2000 | Hettinger et al. | 473/341 |
| 6,227,986 | B1 | 5/2001 | Fisher | |
| 6,231,458 | B1 * | 5/2001 | Cameron et al. | 473/332 |
| 6,238,302 | B1 * | 5/2001 | Helmstetter et al. | 473/340 |
| 6,270,422 | B1 | 8/2001 | Fisher | |
| 6,273,832 | B1 * | 8/2001 | Helmstetter et al. | 473/324 |
| 6,287,215 | B1 | 9/2001 | Fisher | |
| D459,422 | S | 6/2002 | Fisher | |
| 6,402,636 | B1 * | 6/2002 | Chang | 473/324 |
| 6,475,099 | B1 * | 11/2002 | Sumitomo et al. | 473/290 |
| 6,632,391 | B1 * | 10/2003 | Helmstetter et al. | 264/319 |
| 6,695,708 | B2 | 2/2004 | Fisher | |
| 6,872,439 | B2 * | 3/2005 | Fearing et al. | 428/99 |
| 6,893,358 | B2 * | 5/2005 | Dewanjee et al. | 473/340 |
| 6,971,960 | B2 * | 12/2005 | Dewanjee et al. | 473/340 |
| 6,991,851 | B2 * | 1/2006 | Krepski et al. | 428/423.1 |
| 7,048,648 | B2 * | 5/2006 | Breier et al. | 473/340 |
| 7,070,516 | B2 * | 7/2006 | Dewanjee et al. | 473/340 |
| 7,115,041 | B2 * | 10/2006 | Guard et al. | 473/251 |
| 7,144,335 | B2 * | 12/2006 | Breier et al. | 473/340 |
| 7,192,363 | B2 * | 3/2007 | Blankenship | 473/326 |
| 7,273,420 | B2 * | 9/2007 | Wright | 473/329 |
| 7,278,926 | B2 * | 10/2007 | Frame | 473/329 |
| 7,341,527 | B1 | 3/2008 | Fisher | |
| 7,625,299 | B2 * | 12/2009 | Fujimoto | 473/340 |
| 7,786,243 | B2 * | 8/2010 | Wu et al. | 528/64 |
| 7,993,211 | B2 * | 8/2011 | Bardha | 473/251 |
| 8,066,587 | B2 * | 11/2011 | Tateno et al. | 473/331 |
| 8,262,499 | B2 * | 9/2012 | Murphy | 473/309 |
| 2002/0111228 | A1 * | 8/2002 | Chang | 473/324 |
| 2005/0003146 | A1 | 1/2005 | Spath | |
| 2007/0004535 | A1 | 1/2007 | Hsu | |
| 2008/0125240 | A1 | 5/2008 | Tateno et al. | |
| 2008/0234063 | A1 * | 9/2008 | Ahlquist | 473/219 |
| 2010/0331107 | A1 * | 12/2010 | Rick | 473/349 |

FOREIGN PATENT DOCUMENTS

| | | | | |
|---|---|---|---|---|
| GB | 2451320 | A * | 1/2009 | A63B 53/04 |
| JP | 01254179 | A * | 10/1989 | A63B 53/04 |
| JP | 5 237209 | | 9/1993 | |
| JP | 05237206 | A * | 9/1993 | A63B 53/04 |
| JP | 10-108927 | | 4/1998 | |
| JP | 11128414 | A * | 5/1999 | A63B 53/04 |
| JP | 11253584 | A * | 9/1999 | A63B 53/00 |
| JP | 2001 224716 | | 8/2001 | |
| JP | 2001299969 | A * | 10/2001 | A63B 53/04 |
| WO | WO 2010/099530 | | 9/2010 | |

OTHER PUBLICATIONS

Written Opinion dated May 3, 2010 for Application No. PCT/US2010/025751.

Eagle One, Automotive Appearance Products, http://www.eagleone.com/pages/products/product.asp?itemid=1103, printed May 9, 2011, pp. 1-2.

Friction, http://en.wikipedia.org/wiki/Friction, printed May 9, 2001, pp. 1-14.

Molecular self-assembly, http://en.wikipedia.org/wili/Molecular_self-assembly, printed May 9, 2011, pp. 1-5.

Polymer, http://en.wikipedia.org/wiki/polymer, printed May 9, 2011, pp. 1-16.

Shore durometer, http://en.wikipedia.org/wiki/Shore_durometer, printed May 9, 2001, pp. 1-4.

Stimpmeter, http://en.wikipedia.org/wiki/Stimpmeter, printed May 9, 2011, pp. 103.

Van der Waals force, http://en.wikipedia.org/wiki/Van_der_Waals_force, printed May 9, 2011, pp. 1-5.

Washington Mills, ANSI Grit Size Conversion Chart, received Apr. 13, 2011.

International Search Report and Written Opinion dated Mar. 12, 2012 for Application No. PCT/US2011/035513.

* cited by examiner

GOLF CLUB WITH HIGH FRICTION STRIKING SURFACE

PRIORITY

This application claims priority to and benefit of U.S. Provisional Application No. 61/156,041, filed Feb. 27, 2009, U.S. Provisional Application No. 61/237,379, filed Aug. 27, 2009, and PCT/US10/25751 filed Mar. 1, 2010, all such applications herein incorporated by reference in their entirety.

BACKGROUND

It is generally known that even if a golf ball is struck with a "perfect robot" (or any other form of precision mechanism) on a "perfect striking surface," there may still be significant variation in the resulting ball-direction. Such variation may be caused by spherical asymmetry in the mass and/or shape of the ball or by surface irregularities on the golf club or ball—for example, the dimpled-surface pattern of a golf ball. The dimpled pattern is an inherent part of golf-ball design and is provided to enhance aerodynamic performance. Because of the dimpled-surface design, the resulting trajectory of the ball after being struck by the golf club may depend on local surface features of the ball. The force imparted on the ball may not be along a direction normal to the generally spherical ball shape—instead, the trajectory may be influenced by the local high and low points on the surface of the ball. For example, during the course of club stroke, the dimple on the ball may cause the ball to slide across the generally smooth face of the club, imparting "spin" (rotation) on the ball, which may or may not be desirable. When hitting an approach shot to the green, for instance, a golfer may wish to put spin on the ball to better control the ball upon its impact with the green surface. On the other hand, spin may be less desirable when a golfer is putting, for example, and precise control of the ball's trajectory off the striking surface is necessary. Thus, it may be advantageous to provide a system for reducing the amount of rotation imparted to a golf ball. While a variety of improvements to golf equipment have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

Figure 1:
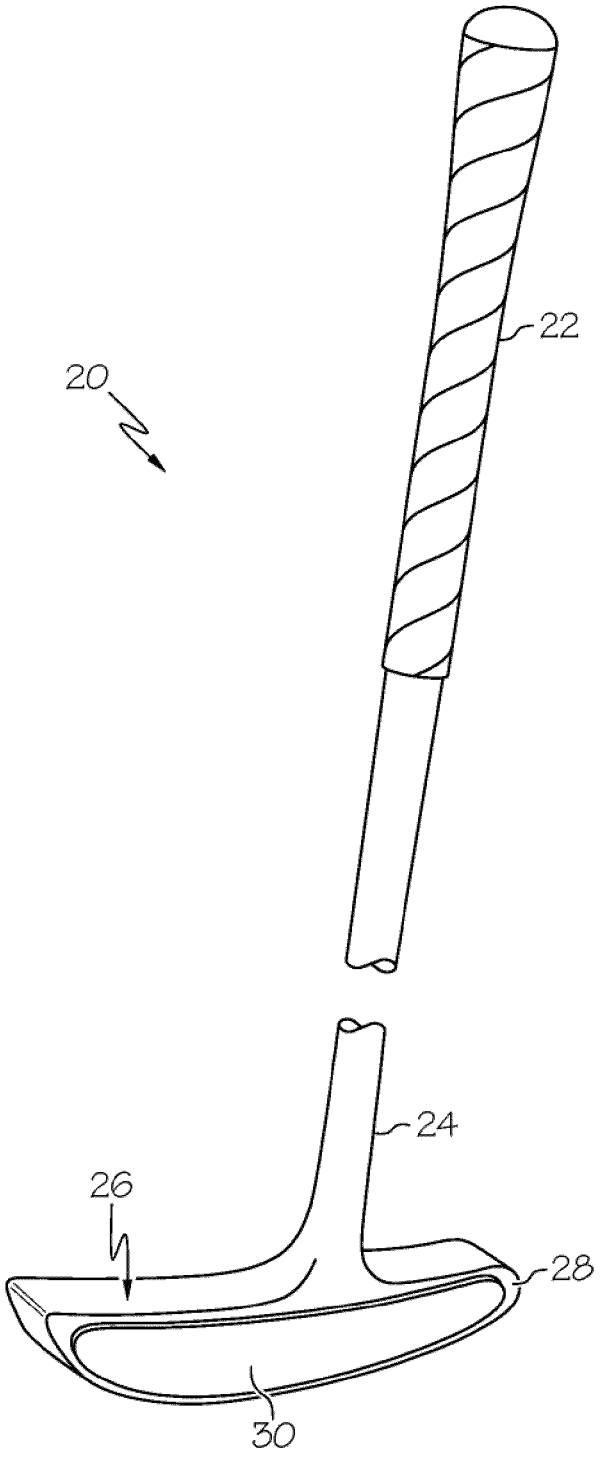
FIG. 1 is a perspective view of an exemplary golf putter.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other features, aspects, and advantages of the versions disclosed herein will become apparent to those skilled in the art from the following description, which is by way of illustration, one of the best modes contemplated for carrying out the invention. As will be realized, the versions described herein are capable of other different and obvious aspects, all without departing from the invention. Accordingly, the drawings and descriptions should be regarded as illustrative in nature and not restrictive.

Versions of the present invention comprise a striking surface of a golf club, where the surface has been treated to increase its coefficient of friction and thereby reduce the spin imparted to a golf ball upon contact. For purposes of this disclosure, "treatment" or "treating" a golf club surface should be understood to include any process, method, manner, application, or material selection that causes an increase in the frictional force imparted by the surface. The term "striking surface" means that portion of a club intended to make contact with a golf club, and includes both a surface applied to a club, a surface of an insert within a golf club, and a surface of a golf club itself, and is not intended to be limited to a surface layer applied to a golf club. As will be described in greater detail below, the means for increasing the friction between the surfaces of the golf ball and golf club may comprise any one or a combination of treatment methods and/or manufacturing methods, including but not limited to material selection, surface material variation, and physical patterning of the surface on a micro- and/or nano-scale.

Referring to FIG. 1, one example of a typical golf club (20) is shown. In this example, golf club (20) comprises a gripping portion (22) around which a golfer can position his hands to swing the club (20), and a shaft (24) extending from the gripping portion (22) and terminating at a club head (26). The club head (26) further comprises a club face (28), which includes a striking surface (30) that comes into contact with a golf ball during a golfer's swing. As will be understood by one of ordinary skill in the art, club face (28) includes not only the outermost portion of deformable material that actually touches the ball, but also any other material(s) or subsurface (s) of the striking surface (30) that may contribute to striking or otherwise acting on a golf ball when struck by the club (20). In one aspect, the striking surface comprises an insert comprising a suitable material as disclosed here. The insert may be cast into a cavity of a golf club, or alternatively molded and then permanently affixed into the insert cavity of the golf club.

Figure 6:
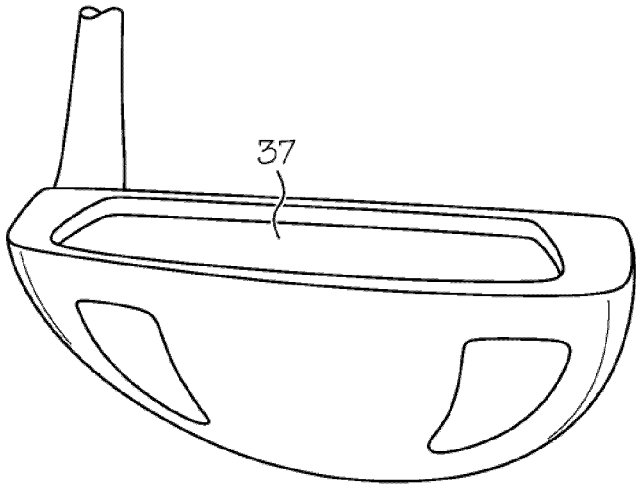
FIG. 6 is a perspective view of an exemplary golf putter having a cavity for receiving an insert.

In addition, although FIG. 1 depicts a golf club (20) that will be recognizable to most golfers as a putter, for use on and around a putting green, golf club (20) should not be limited to putters and corresponding putting applications. By way of example only, golf club (20) may be a wood, an iron, or a hybrid/utility club without departing from the scope of this disclosure. A material selected to comprise striking surface (30) may be coupled to club head (26) in any suitable manner as will be appreciated by one of ordinary skill in the art. For example, a non-slip material may be removably attached to or inserted into club face (28) by an adhesive, such as dried glue or tape, club face (28) may be coated with a material, such as diamond powder, or a selected material may be integral with the club face (28) in the form of an insert. For example, the desired material may be poured into a cavity (37) of club face (28) as depicted in FIG. 6. In this example, a temporary pocket may be formed at the perimeter of club head (26) to contain the liquid material until it hardens. In addition, a non-slip material, such as a material having a low durometer and/or high frictional surface, may be incorporated into an insert that is integral with club head (26). It should be noted that cavity (37) may take a variety of different shapes and sizes, and is not to be limited to that depicted in the figures.

Figure 2:
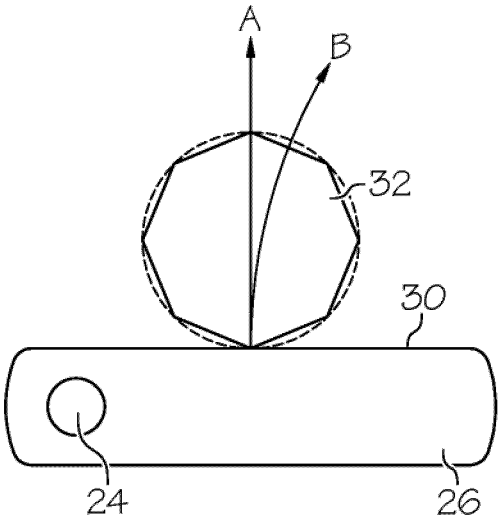
FIG. 2 is a schematic diagram of a golf ball contacting an untreated club surface.
Figure 3:
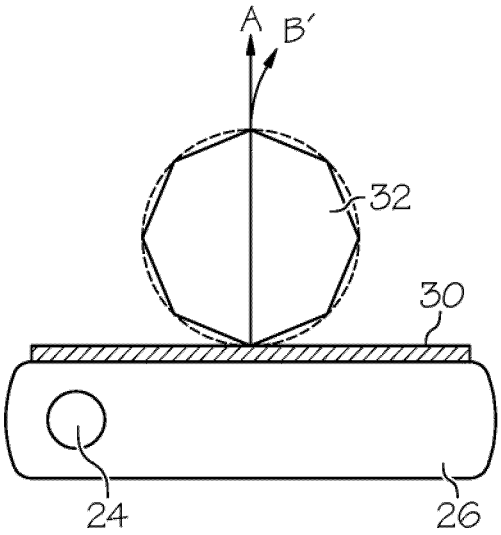
FIG. 3 is a schematic diagram of a golf ball contacting a treated club surface.

FIGS. 2-3 demonstrate the effects of spin on a golf ball's trajectory. Both figures show the surface (30) of club head (26) striking a golf ball (32). But in FIG. 2, the striking surface (30) has been untreated, permitting a greater amount of spin to be imparted to the ball (32), causing its rotation. Thus, instead of travelling along a desired trajectory, path A, that is substantially normal to the club face (28), the golf ball (32) travels along path B, shown to be veering at a significant angle from path A. By contrast, FIG. 3 shows a striking surface (30) that has been treated in accordance with the present disclosure. In this figure, the treatment of surface (30) reduces the amount of spin imparted to the ball (32) upon contact. The actual trajectory along path B' is substantially closer to the desired trajectory, path A, than in FIG. 2, where the surface (30) was untreated.

Figure 4A:
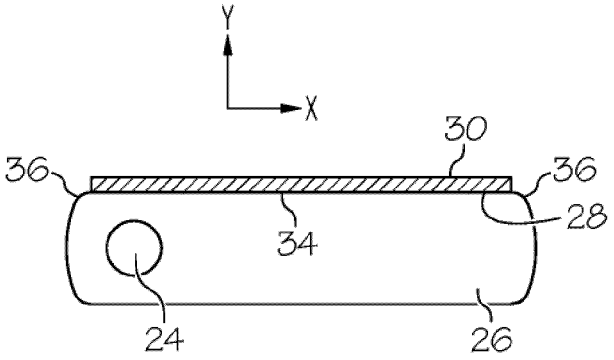
FIG. 4*a* is a cross-sectional view of an exemplary club head, treated according to a disclosed methodology.
Figure 7:
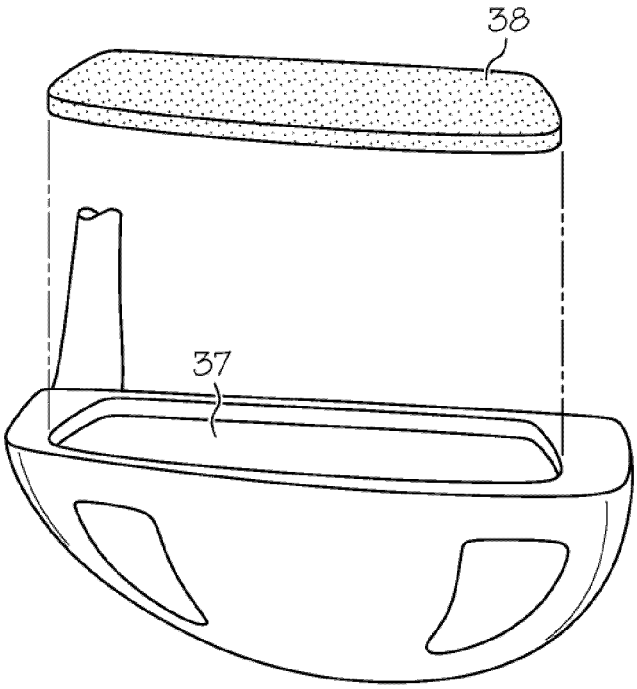
FIG. 7 is a perspective view of an exemplary insert for placing in a cavity of a golf club.
Figure 8:
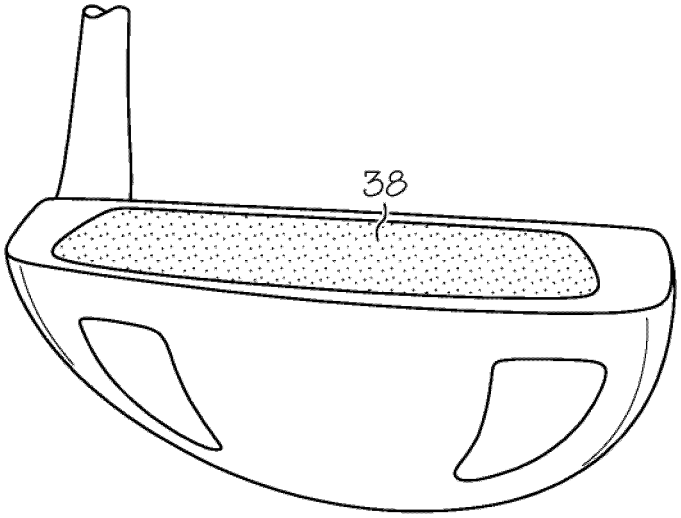
FIG. 8 is a perspective view of an exemplary club containing an insert.

Referring now to FIG. 4*a*, an exemplary treated striking surface (30) is shown. As will be understood by one of ordinary skill in the art, striking surface (30) may be treated in any variety of manners to increase the coefficient of friction on the surface (30). By way of example only, striking surface (30) may be treated by selectively choosing the material(s) comprising the striking surface (30). In one aspect, the striking surface (30) may be treated by applying one or more abrasive, non-slip, or otherwise friction-increasing materials to the surface (30). Referring to FIGS. 6, 7, and 8, in another aspect, the striking surface (30) is the surface of an insert (38) placed in a cavity (37) of a club head (26). The striking surface and/or insert (38) may comprise an insert material comprising a friction-increasing material. The friction-increasing material may comprise an abrasive material selected from diamond, diamond powder, zirconia, zircon, silicon dioxide, aluminum oxide, silicon carbide, boron nitride, other mineral forms of the same, glass particles, ceramic particles, and polymer crystals.

One or more materials for treating striking surface (30) and/or incorporating into an insert may alternatively or additionally comprise a material that increases the Van der Waals forces between the surface (30) and the ball (32). For example, a polymeric carbon or silicone material that cures by self-ordered means to form high Van der Waals structures may be applied to surface (30) or incorporated into an insert. One such example is a room-temperature-vulcanizing silicone, such as that available from Dow Corning (also referred to as silicone RTV). Other examples of methods to increase intermolecular forces between surface (30) and ball (32) include: incorporation of geometric micro- or nano-"hairs" to surface (30) or insert to maximize surface contact Van der Waals forces; physical formation of micro- or nano-"teeth" onto surface (30) or insert by machining, electro-forming, electro-machining, or replicate optic means; or application of gecko tape or other biomimetic adhesive to surface (30) and/or incorporated into an insert. An increase in such intermolecular forces may reduce the tangential force component of the club (20)-to-ball (32) interaction, thereby reducing the resulting rotation of the ball (32). In another aspect, the material may comprise thermoplastics such as styrene co-polymers, co-polyesters, polyurethanes, polyamides, olefins and vulcanates; and thermosets such as epoxides, polyimides, polyesters and silicones.

Figure 4B:
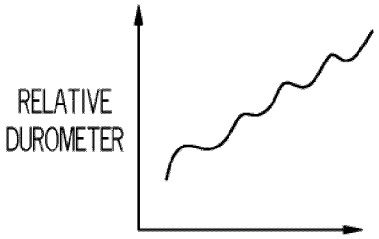
FIG. 4*b* is a schematic graph showing an exemplary durometer gradient for the striking surface depicted in FIG. 4*a*.
Figure 4C:
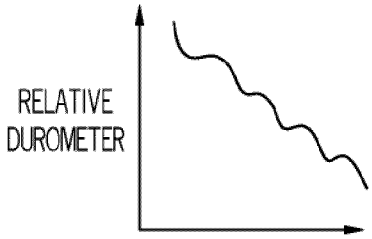
FIG. 4*c* is a schematic graph showing an alternative exemplary durometer gradient for the striking surface depicted in FIG. 4*a*.
Figure 4D:
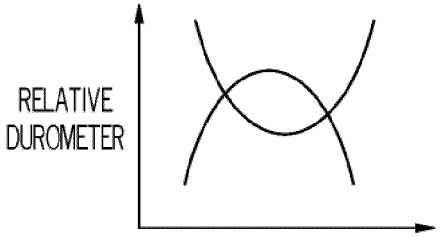
FIG. 4*d* is a schematic graph showing an alternative exemplary durometer gradient for the striking surface depicted in FIG. 4*a*.
Figure 5A:
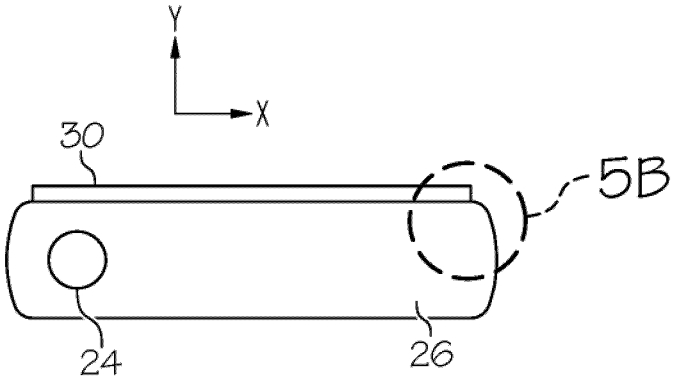
FIG. 5*a* is a cross-sectional view of an exemplary club head, treated according to a disclosed methodology, to form a layered striking surface.
Figure 5B:
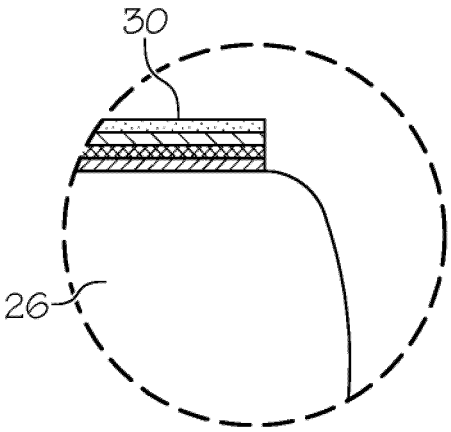
FIG. 5*b* is a cross-sectional view of an exemplary layered striking surface from Detail C of FIG. 5*a*.
Figure 5C:
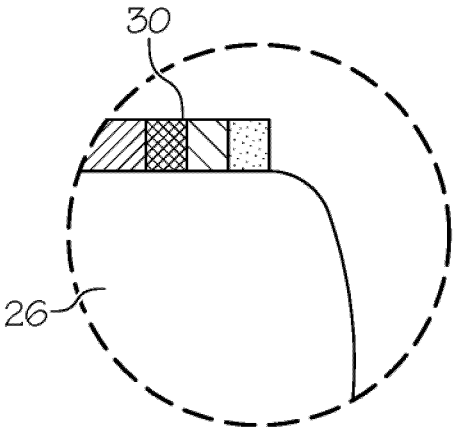
FIG. 5*c* is a cross-sectional view of an alternative layered striking surface from Detail C of FIG. 5*b*.

In one aspect, a material having a relatively low durometer (as measured using methods known in the art, such as ASTM D2240) such as silicone or another material with a durometer of less than or equal to 100 Shore A hardness, may be used. The durometer of striking surface (30) may be uniform across the surface (30) or it may have a gradient along at least one dimension. For example, the durometer of surface (30) may be generally constant of less than or equal to 100 Shore A hardness. By contrast, FIGS. 4*b*-4*d* show exemplary durometer profiles based on varying the durometer along the y-direction, which in FIG. 4*a* corresponds to the thickness of surface (30). Of course, the durometer of surface (30) may vary along any other direction, e.g., the x-direction. By way of example only, the durometer may be less than or equal to 100 Shore A harness towards the center (34) of striking surface (30) and gradually increase along the x-direction, in both directions, towards the outer edges (36) of club head (26). FIGS. 5*a*-5*c* show examples of a layered striking surface (30) having varying layers of durometer. FIG. 5*b* illustrates varying layers along the y-direction, while FIG. 5*c* illustrates varying layers of durometer along the x-direction (and about the y-axis). Although FIGS. 5*b* and 5*c* each show striking surface (30) as comprising four layers of durometer, striking surface (30) may comprise one or more layers as will be appreciated by one of ordinary skill in the art.

In one aspect, a golf club for reducing the spin imparted to a golf ball is disclosed, wherein the golf club may comprise a club head comprising a striking surface having a coefficient of friction greater than about 0.5, or greater than about 0.6, or greater than about 0.7. The striking surface may comprise an insert integral with the golf club head. In one aspect, the striking surface may have a coefficient of friction of from about 0.5 to about 50, or from about 0.5 to about 30, or from about 0.5 to about 20, or from about 0.5 to about 25, wherein coefficient of friction is measured according to the method disclosed herein.

In one aspect, the striking surface may comprise an insert comprising a self-ordering material. The self ordering material may comprise a material wherein the Van der Waals forces of the material cause the coefficient of friction between the ball and the striking surface to be greater than about 0.5, greater than about 0.6, or greater than about 0.7, or from about 0.5 to about 50, or from about 0.5 to about 30, or from about 0.5 to about 20, or from about 0.5 to about 25. In one aspect, the self ordering material may comprise a resin-like material. In one aspect, the self ordering material may be selected from a polymer known in the art, such as, for example, a urethane, a silicone, or a combination thereof.

In one aspect, the striking surface may comprise an insert comprising an abrasive material. In this aspect, the abrasive material may be selected from diamond, diamond powder, zirconia, zircon, silicon dioxide, aluminum oxide, silicon carbide, boron nitride, glass particles, ceramic particles, or a combination thereof. In this aspect, the abrasive material may have a size of from about 20 grit to about 5000 grit, or from about 50 grit to about 2000 grit, or from about 200 grit to about 1500 grit, or from about 300 grit to about 1000 grit. In one aspect, the abrasive material may have a size of from about 200 grit to about 300 grit, or about 220 grit. The abrasive material may be round, or in other aspects, may be not substantially round. In other aspects, the striking surface may comprise an abrasive material having sharp facets. In one aspect, said sharp facets may aligned, such that the facets point in substantially the same direction. The striking surface may also comprise nanohairs. In a further aspect, the striking surface may comprise a material selected from an abrasive material, a self ordering material, nanohairs, or a combination thereof.

In addition to increasing the coefficient of friction on striking surface (30) by material selection, other treatment measures may be used to reduce the spin on a golf ball (32). By way of example, striking surface (30) may be physically modified by mechanical, chemical, and/or electro-chemical means. In some versions, striking surface (30) may be wholly or selectively patterned, such as in a honey-comb pattern, to increase the frictional force at the striking surface (30). Such patterning may be applied using, for example, diamond or other abrasive material, or a combination thereof. A non-exclusive list of methods of patterning includes machining, chemical etching, and laser ablation. Other methods of adding micro- and/or nano-features to surface (30) include contact etching, where club face (28) is submerged in an electro-polishing acid, and electro-etching, where club face (28) is submerged in an electro-polishing acid and a voltage is applied. Similar techniques may be used to modify any non-metallic materials comprising striking surface (30). For example, instead of the acid or voltage described with regard to metal surface etching, surface (30) may be "contact etched" by submerging in a polymer solvent and physical pressure may be applied to modify surface (30) of club face (28). Other examples of striking surface (30) modification include a replicate optics process, which may be used to fabricate micro- or nano-scale geometries on a non-metallic insert, and a nanoimprint lithography process, which may be utilized to rapidly and inexpensively manufacture micro- or nano-scale non-slip geometries on a polymer surface insert. Still other versions of striking surface (30) modification involve attachment of micro- or nano-"hair" to the striking surface (30), where the "hair" may be formed by chemical vapor deposition, a plasma generator, an arc discharge technique, or laser ablation of carbon or catalytic chemical vapor deposition. The striking surface may also comprise a surface wherein the coefficient of friction of said striking surface varies across the striking surface and is arranged in a manner selected from uniform, top to bottom gradation, left to right gradation, concentric gradation, alternating gradation, or a combination thereof.

In another aspect, the striking surface may comprise a glitter or other reflective substance to provide an aesthetic effect to the user. In other aspects, the glitter can be a colored glitter, or the color of the poured or pre-formed insert may be colored to enhance aesthetic appeal to the user.

It will be understood that a removable striking surface (30), whether in the form of a strip, an insert, or the club head itself, may be modified before or after it is affixed to club head (26). If striking surface (30) is integral with club head (26), such as in the form of an insert, treatment may be applied to the surface (30) singly or along with the entire head (26) and/or club (20).

The components, features, configurations, and methods described above may be incorporated into any golf club. It should be further appreciated that the methods may involve a single process, such as contact etching, or a combination of methods. For example, surface (30) may be treated to increase its surface friction by selecting an abrasive material, such as diamond powder, to comprise surface (30), coating the diamond powder onto club face (28), and further contact etching surface (30) to create micro- and/or nano-scale geometries on surface (30). Still other additional and alternative suitable components, features, configurations, and methods of using and forming the above-described treated striking surface (30) will be apparent to those of ordinary skill in the art in view of the teachings herein.

In a further aspect, a method of reducing the amount of spin on a golf ball is disclosed, wherein the method may comprise the steps of providing a golf club comprising a striking surface; and modifying the striking surface to increase its coefficient of friction. It should be noted that the coefficient of friction measured at the instant of impact with a golf ball may be substantially higher than values obtained when the coefficient of friction is measured when the ball and club are simply in contact with each other. The act of modifying the striking surface may comprise inserting a material into the golf club face such that the striking surface has a coefficient of friction with the ranges described above. The method may further comprise the step of modifying the insert via a method selected from patterning, machining, etching, laser ablating, replicate optics manufacturing, nanoimprint lithography, incorporating an abrasive material, or a combination thereof.

In a further aspect, a method of making a golf club comprising an insert is disclosed, wherein the method may comprise the steps of providing a golf club having a cavity (37) in a head of the golf club; and placing a composition comprising a material into cavity (37), wherein the material provides a striking surface having a coefficient of friction within the ranges described above. In one aspect, the act of placing may comprise placing material in a non-solid state into cavity (37), wherein the material subsequently hardens to form a striking surface. In another aspect, the act of placing may comprise placing a preformed material such as insert (38) into the cavity (37). In one aspect, the composition may comprise an insert material selected from self-ordering materials, abrasive materials, and a combination thereof, as described above. In one aspect, the method may further include the steps of providing a cover with a smooth surface; coating the smooth cover with a layer of nanowax or the like; coating the smooth cover comprising nanowax with an abrasive particle. The cover may then be placed on the striking surface containing the insert material while the insert material is in a liquid or semi-liquid state. In a further aspect, the cover comprising nanowax with abrasive particles may be inverted prior to placing the cover on the cavity for a length of time sufficient to allow loose abrasive to fall from the plate. The cavity may then be covered with the cover comprising nanowax and abrasive and optionally clamped into place. The club head comprising the cavity containing insert material may be inverted such that the cavity faces in a downward direction, such that the contents of the cavity are in contact with the cover. After hardening of the insert material, the cover may be removed.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. All exemplified concentrations are weight-weight percents, unless otherwise specified.

Example 1

Part A Devcon Flexane® 94 Liquid 15250, a castable, non-shrinking, low-viscosity urethane compound available from Devcon that cures to a Hardness Shore A of approximately 97, is poured into a mixing vessel. Any bubbles that form are allowed to rise to the surface and are removed. The vessel and Devcon Flexane 94 part A may optionally be placed in an oven and heated to approximately 105° F. to lower the viscosity of the Flexane 94 part A to facilitate bubble removal. The Flexane 94 part A is then mixed with 40% by weight of 220 grit Silicon Carbide and 1% by weight of metallic glitter. Air bubbles are removed from the well-mixed Flexane 94 part A, 220 grit SiC and optional glitter material. This can optionally be expedited by heating the mixture to approximately 105° F. and then removing any air bubbles at or under the surface of the mixture. Flexane 94 part B is then added in the ratio of 39:61 of Flexane part B by weight. The final component is carefully mixed to avoid the inclusion of air bubbles which might result in variations along the surface and/or reduce the coefficient of restitution of the insert and the inserted putter and/or the ability to transmit mechanical energy along the club. The application of a slight partial vacuum, typically ½ bar, can be used to quickly minimize the presence of air bubbles. The well-mixed final mixture can then be poured into the insert cavity of a Callaway Odyssey putter on the striking surface plane of the putter. The mixture is poured into the cavity until slightly overfilled. A flat polished cover of window glass is coated with Nanowax® (manufactured by Eagle 1 Automotive Appearance Products). The flat polished cover is coated with silicone carbide by pouring onto the surface of the cover and allowing excess to be removed by inversion. The cover is then affixed over the putter face such that the nanowax/abrasive side of the cover is in contact with the mixture poured into the cavity to form the flat, smooth planar surface of the insert in the putter face. The putter head is inverted such that the striking surface is facing down to prevent the 220 grit SiC from sinking away from the striking surface during the cure period. The assembly is then placed in an oven heated to approximately 105° F. to accelerate curing. After several hours the assembly can be removed from the oven and the cover plate removed. A solvent such as ethyl alcohol or xylene can then be used to clean the surface of the insert and putter and remove any residual nano-wax. The resulting durometer value of the striking surface is greater than at least 85 Shore A, and the resulting striking surface of the putter reduces the standard deviation of putted balls by approximately 50%.

Example 2

Measurement of Coefficient of Friction between Golf Ball and Putter

A digital trigger pull gauge, for example, a 0 to 12 pounds Electronic Trigger Pull Gage (Lyman, Manufacturer No. 7832248) is used to measure the Coefficient of Friction (COF) of a putter striking surface. The gauge is attached to a Stelron roller ball linear slide, catalogue number DS4-4.5-A. A Pro V1® golf ball (manufactured by Titleist®) is affixed into a carriage that prevents ball rotation, allowing only that the constrained ball can be dragged across each test surface. The data is the force necessary to drag the 45.8 gm ball and the 38.4 gm holder ring across each surface. The COF is calculated by dividing the pulling force by the total weight of the ball and ring (84.2 gm). The coefficient of friction measured for prior art putter and inserts ranges from 0.2 to 0.40. The coefficient of friction measured for putters and putter inserts of the instant disclosure ranges from 0.5 to greater than 5.0.

Example 3

Measurement of Putting Standard Deviation

A single axis pendulum "Iron Byron Putting Machine" was constructed to mimic the classic "pendulum" putting stroke. The "Iron Byron Putting Machine" is intended to match the physical size of typical human golfers in a typical putting stance. The pendulum measures 45½ inches from the center of rotation axis to the putting surface. A replaceable striking surface, replicating a putter, was fabricated from ¼" thick aluminum rectangular stock 1½" tall by 3" width is affixed to the pendulum swing arm, with ~⅛" clearance above the putting surface. The pendulum is provided with a rigid, weighted support frame and the rotating axis moves on two low friction ball-bearings rigidly mounted to the support frame. A ball positioning fixture positions the golf ball for each trial precisely touching the free hanging replaceable striking surface. The striking surface can be precisely angled relative to the vertical so that putter loft can be set to mimic any trial loft from ~−−6° to +6°. A positive loft of approximately 3° or 4° is used to mimic typical putter construction. The test putting surface is a 9' long and 1.5" thick slate pool table which is quite durable, repeatable and similar in putting speed to tournament golf greens. This test condition provides an essentially permanent, non-changing test condition that cannot be duplicated with actual living putting greens which change with grass height, sun angle, temperature, moisture, base texture and numerous other un-controllable variables.

For each trial, the golf ball is precisely positioned in front of the striking surface with no attempt to predetermine the alignment of golf ball dimples at the point of contact with the striking face. Before actual data taking for each striking face, preliminary trials were run to determine the exact pull back distance necessary to carry the ball ~4 inches beyond a 4 inch diameter "hole" located 6 feet from the at-rest striking surface, on average. A grid was established relative to the "hole" so that the final ball location could be recorded for each putting trial. Putts ending short of the "hole" were measured as negative inches, putts ending beyond the hole in length were measured as positive inches. From the perspective of the putting pendulum, putts ending to the left were measured as positive inches and those ending to the right were measured as negative inches.

Figure 9:
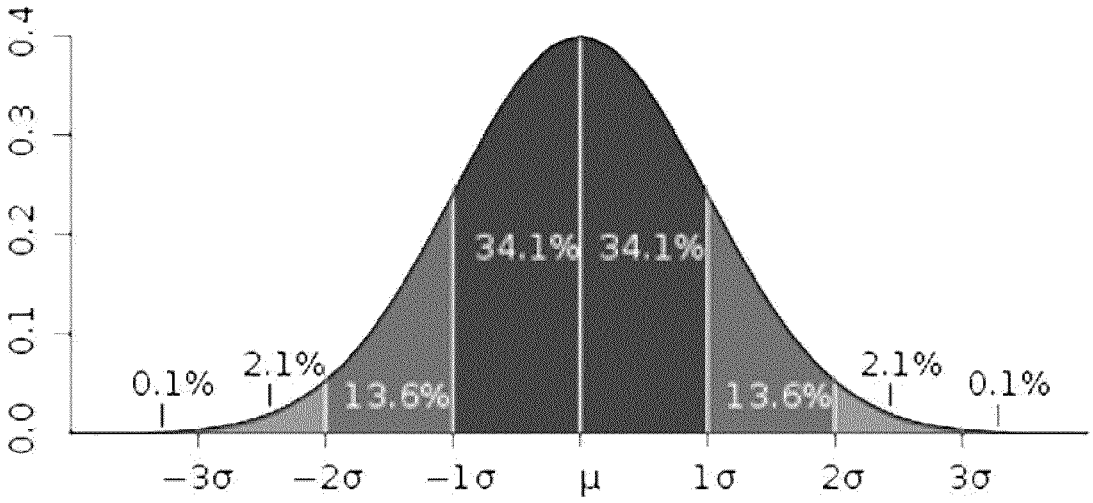
FIG. 9 is a Standard Deviation Diagram for normal distribution population.

The "Control" striking surface was the smooth metal face of the ¼"×1½"×3" striking plate. Typically 100 trials were run using a Titleist Pro V1 golf ball (manufactured by Titleist®) and the x,y data of ending ball positions were recorded for each trial. The standard deviation of these data was calculated and typically found to be approximately 4". That is, about 68% of mechanically "perfect" putts would have been made and 32% would have been missed. Standard Deviation Diagram for normal distribution population is shown in FIG. 9.

High speed, 300 frames per second, video showed that the exact location and position of the golf ball facet contacting the striking surface determined the amount of tangential spin imparted to the golf ball. The direction and amount of this tangential spin determines both the putt length and direction. Substitution of an acrylic sphere of similar size and weight as a golf ball results in almost perfectly repeatable putting final ball position. That is, it was found that the faceting present on modern golf balls, so necessary for long ball flight for woods and irons shots, has a large detrimental effect on putting accuracy. By increasing the coefficient of friction of the striking surface a very significant reduction on the amount of tangential ball spin and putting accuracy is observed. For example, mounting wet/dry sanding abrasive paper onto the surface of the striking surface as described above (the abrasive paper having a grit of from about 80 grit to about 1500 grit) reduced the standard deviation of putts from 4" to 2". That is, 95.4% of mechanically perfect putts would have gone in the hole and only 4.6% would miss the hole.

Example 4

Putter Insert Test Results

A test striker plate identical to the Control plate described above, was machined to have a 1" (h) by 1" (width) by 1 mm (depth) cavity. The test insert was fabricated by preparing the insert material according to Example 1, without glitter and without application of heat or vacuum. The insert material was then poured into the cavity. Any bubbles rising to the surface were punctured. A smooth glass plate was sprayed with nanowax, then dusted with 220 grit silicone carbide. The glass plate is then turned over to allow excess silicone carbide to fall from the surface of the glass plate. The glass plate was placed on the surface of the test striking plate and clamped in place. The test plate with clamped glass cover plate was then turned upside down and placed at 105 degrees F. overnight. After curing, the cover plate was remove, exposing a striking surface substantially smooth, but with grit exposed on the surface. The plane of the insert has a striking surface coincident with the machined metal portion of the putter striking surface within −0.004" and +0.006", with uniform surface roughness. The test striking plates were evaluated on the previously described "Iron Byron" mechanical putting pendulum and achieved approximately a 2" standard deviation in ball final resting position as compared to an approximately 4" standard deviation found in the control striking surface.

All percentages and ratios are calculated by weight unless otherwise indicated.

All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "20 mm" is intended to mean "about 20 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A golf club for reducing the spin imparted to a golf ball, the golf club comprising:

a. a gripping portion around which a golfer can position his hands to swing the golf club;

b. a shaft having a first end and a second end, wherein the gripping portion extends from the first end of the shaft; and c. a club head extending from the second end of the shaft, the club head comprising a cavity containing a solid insert integral with the club head, said solid insert comprising a self-ordering material and an abrasive material;

wherein the solid insert comprises a striking surface for striking the golf ball;

wherein said striking surface has a durometer of less than or equal to 100 Shore A hardness; and wherein said golf club is a putter.

2. The golf club of claim 1, wherein the abrasive material is selected from diamond, diamond powder, zirconia, zircon, silicon dioxide, aluminum oxide, silicon carbide, boron nitride, glass particles, ceramic particles, polymer crystals, or a combination thereof.

3. A golf club according to claim 1, wherein said striking surface comprises a coefficient of friction of from about 0.5 to about 50.

4. A golf club according to claim 1, wherein said striking surface comprises a self-ordering material, wherein said self ordering material comprises Van der Waals forces yielding a coefficient of friction with the golf ball greater than about 0.5.

5. A golf club according to claim 1 wherein said self ordering material comprises a resin-like material.

6. A golf club according to claim 1 wherein said self-ordering material is selected from a urethane, a silicone, or a combination thereof.

7. A golf club according to claim 1 wherein said abrasive material has a size of from about 20 grit to about 5000 grit.

8. A golf club according to claim 1 wherein said abrasive material has a size of from about 200 grit to about 300 grit.

9. A golf club according to claim 1 wherein said abrasive material is not substantially round.

10. A golf club according to claim 1 wherein said abrasive material comprising sharp facets.

11. A golf club according to claim 1 wherein said abrasive material comprises sharp facets, wherein said sharp facets are aligned.

12. A golf club according to claim 1 wherein said striking surface comprises nanohairs.

13. A golf club according to claim 1 wherein said striking surface comprises a surface wherein said coefficient of friction of said striking surface varies across said striking surface and is arranged in a manner selected from uniform, top to bottom gradation, left to right gradation, concentric gradation, alternating gradation, or a combination thereof.

14. A golf putter according to claim 1, wherein said striking surface comprises a coefficient of friction of from about 0.6 to about 50.

15. The golf club of claim 1, wherein said striking surface has a coefficient of friction of about 0.5 or greater.

16. A golf putter according to claim 1, wherein said striking surface has a coefficient of friction of about 0.6 or greater.

* * * * *